United States Patent [19]

Kondo et al.

[11] 4,398,254

[45] Aug. 9, 1983

[54] METHOD FOR CONTROLLING STRIP THICKNESS IN STRIP MILL

[75] Inventors: Katsuya Kondo, Amagasaki; Shigeru Tajima, Osaka, both of Japan

[73] Assignee: Sumitomo Metal Industries, Ltd., Osaka, Japan

[21] Appl. No.: 270,511

[22] PCT Filed: Oct. 25, 1980

[86] PCT No.: PCT/JP80/00265

§ 371 Date: Jun. 4, 1981

§ 102(e) Date: Jun. 4, 1981

[87] PCT Pub. No.: WO81/01257

PCT Pub. Date: May 14, 1981

[30] Foreign Application Priority Data

Oct. 31, 1979 [JP] Japan ..... 54-141498

[51] Int. Cl.[3] ..... G06F 15/46; B21B 37/12

[52] U.S. Cl. ..... 364/472; 364/563; 72/8

[58] Field of Search ..... 364/472, 476, 563; 72/8–16

[56] References Cited

U.S. PATENT DOCUMENTS

| | | | |
|---|---|---|---|
| 3,592,030 | 7/1971 | Smith, Jr. | 364/472 |
| 3,702,071 | 11/1972 | Masar | 72/8 |
| 4,220,025 | 9/1980 | Baba et al. | 364/472 |
| 4,240,147 | 12/1980 | Morooka et al. | 72/8 |
| 4,248,072 | 2/1981 | Hasegawa et al. | 72/11 |

*Primary Examiner*—Gary Chin

*Attorney, Agent, or Firm*—Wenderoth, Lind & Ponack

[57] ABSTRACT

In a rolling mill for rolling a strip, a method for equalizing the thickness of the strip over the entire length thereof, in which a deviation in the thickness of the strip on the entrance side of the rolling mill is measured by sampling for each predetermined time period (Δt) which is equal to or smaller than 1/5 of the period of the cut-off frequency of a screw down position control device and/or a tension adjusting device of the rolling mill and is stored in a memory, and a control signal is generated using two or more of the stored measured sampled values for each time period Δt, whereby the screw down position control device and/or the tension adjustment device are controlled using the generated control signal.

1 Claim, 4 Drawing Figures

METHOD FOR CONTROLLING STRIP THICKNESS IN STRIP MILL

DESCRIPTION

1. Technical Field

The present invention relates to a method for controlling strip thickness in a strip mill and, particularly, provides a method for controlling strip thickness of a new feed-forward system which is capable of controlling variations in thickness having relatively high frequency components.

2. Background Art

In a strip mill, it is very important to maintain the thickness of the rolled strip to a desired value over its entire length. Heretofore, both in a reversing mill and in a tandem mill, a thickness meter was provided on the exit side of the mill, for detecting the deviation in thickness which was fed back to the mill to correct the screw down position and/or the tension applied to the strip. However, the conventional method for controlling strip thickness utilizing the feed-back system had a disadvantage of a slow response characteristic. In a tandem mill comprising, for example, five stands, it was a common practice to use the method of adjusting the screw down position in the first stand in accordance with the deviation in the strip thickness detected by a thickness meter provided on the exit side of the first stand, in combination with the method of adjusting the tension between the fourth and the fifth stands in accordance with the deviation in the strip thickness detected by a thickness meter provided on the exit side of the fifth stand. In this feed-back system, however, a quick response in control was impossible because of a time lag the detection of the strip thickness by each of the thickness meters provided on the exit sides of the first and the fifth stands.

In order to correct this disadvantage of the feed-back system, a new control method according to a feed-forward system was developed, in which, as described in "Control Engineering March 1955", pp. 42–47, the deviation in the strip thickness detected by the thickness meter provided on the exit side of the first stand was stored and variations in the strip thickness at each stand on the downstream side was predicted by calculation, in accordance with which the tension between the stand on the downstream side was adjusted, to thereby control the strip thickness. In this control method by feed-forward system, although capable of solving the heretofore existed problem of the delay the detection of the deviation in the strip thickness, there was a serious problem that it was almost ineffective for a variation in the strip thickness in which the frequency component was as high as several hertz (Hz) or above, as caused by eccentricity in the roll. This ineffectiveness was due to the fact that a roll drive motor for adjusting the tension between the stands was not capable of satisfactorily following the high frequency variation of several Hz or above. The situation would remain unchanged if adjustment of the rolling position was adopted in place of adjustment of the tension between the stands.

A conventional method for controlling the variations in the strip thickness having such a high frequency component is disclosed in the specification of Japanese patent application No. 129877/76.

This conventional method was applicable to a tandem mill comprising a plurality of stands for rolling a strip, for obtaining variation in the strip thickness between a thickness meter disposed between two adjacent stands and a stand on the downstream side thereof by sequentially storing deviations in the thickness of the passing strip detected by said thickness meter, correcting the amplitude and the phase of the strip thickness variation signal in response to the dynamic characteristic of the electric motor driving the roll of either one of said two stands, and varying the rotational speed of said electric motor in accordance with said correction signal to thereby control the strip thickness. This method, however, did not disclose the control method using a rolling position control apparatus. In performing the feed-forward control, as sampling, using the screw down position control device or the tension adjusting device, the most important techniques are methods for storing and using the deviation of the strip thickness and a method for determining the sampling time. However, the above-mentioned Japanese patent application does not describe any of these most important techniques. Accordingly, the method described in said Japanese patent application, while applicable to specific conditions in which the rolling speed was constant and within a limited range, had a disadvantage that it was not applicable over a wide range as in the case where the rolling speed is changed sharply.

DISCLOSURE OF THE INVENTION

In view of such background art as described above, an object of the present invention is to provide a method for controlling strip thickness, capable of rendering follow-up control against variations in the strip thickness, particularly those of high frequency.

To summarize, the method for controlling the strip mill according to the present invention is applicable to a strip mill comprising a rolling mill for rolling a strip, a screw-down position control device for adjusting the distance between the rolls of said rolling mill, a tension adjusting device for adjusting the tension applied to said strip, and a speed meter for detecting the speed of movement of the strip, and is characterized in that a thickness meter for detecting deviation in the strip thickness is provided on the entrance side of the rolling mill, an output of said thickness meter is detected by a sampling for each predetermined time period $\Delta t$ which is in the range equal to or smaller than 1/5 of the period of the cut-off frequency of said screw down position control device and/or said tension adjusting device, the deviation in thickness of the strip at a plurality of positions between said thickness meter and said rolling mill is stored on the basis of said detected value and the speed of movement of the strip obtained from the speed meter, a control signal for adjusting said screw down position control device and/or said tension adjusting device for each time period $\Delta t$ is computed using two or more values from said stored values in response to the speed of the strip, and said computed value is outputted to said screw down position control device and/or said tension adjusting device.

BEST MODE FOR CARRYING OUT THE INVENTION

The present invention will now be described in detail with reference to the drawings showing an example of practice of the present invention with a tandem mill comprising five stands.

Figure 1:
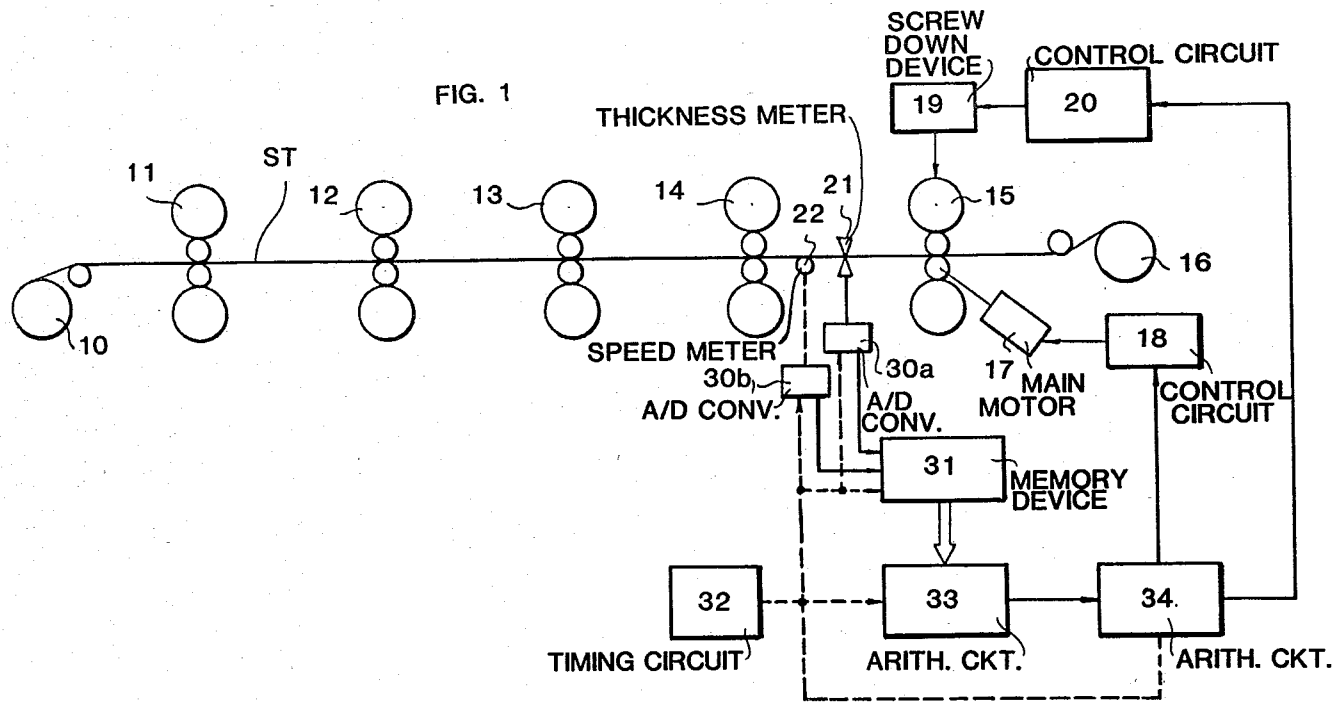
FIG. 1 is a block diagram of the control system for carrying out the method according to the present invention shown in combination with the schematic illustration of the tandem mill.

In FIG. 1 showing a block diagram of the control system for carring out the method according to the present invention shown in combination with the schematic illustration of the tandem mill, reference numeral 10 denotes an uncoiling reel, 11, 12 . . . 15 denote first, second . . . fifth stands (rolling mill), respectively, and 16 denotes a coiling reel. Assuming that the method according to the present invention is applied to the fifth stand 15, since the tension applied to a strip ST between the fourth and the fifth stands is adjusted by adjusting the speed of rotation of a main motor 17 driving the stand 15, said main motor 17 and a control circuit 18 therefor constitute a tension adjusting device for the fifth stand. A screw down device 19 for the fifth stand 15 and a control circuit 20 for controlling the screw down position of said screw down device 19 to a target value constitute a screw down position control device. Reference numeral 22 denotes a speed meter comprising a touch roll or the like disposed between the fourth and the fifth stands for detecting the speed of movement of the strip on the entrance side of the fifth stand 15. Reference numeral 21 denotes a thickness meter disposed on the entrance side of the fifth stand 15. In the illustrated example, the deviation of the strip thickness on the exit side of the fourth stand from the target value, that is a thickness deviation $\Delta h$ is detected, and an electrical signal corresponding to the thickness deviation $\Delta h$ is outputted. The speed meter used in the method may have the construction for calculating the speed of movement of the strip ST on the basis of the speed of rotation of the work roll of the fourth stand and the advance rate of the strip ST. Reference numerals 30*a* and 30*b* denotes A/D (analog/digital) converters and 31 denotes a memory device. Analog outputs from the thickness meter 21 and the speed meter 22 are converted into digital signals by A/D converters 30*a* and 30*b*, respectively, and inputted to the memory device 31 for storage. Reference numeral 32 denotes a timing circuit for generating a pulse for each period $\Delta t$ of said sampling and calculation, 33 and 34 denote arithmetic circuits for computing control signals to be applied to the control circuits 18 and 20. Besides, a central processing unit CPU (not illustrated) is provided to control the transfer and processing of the signals. The circuit functions described above may be performed by data processing in the CPU.

Figure 2:
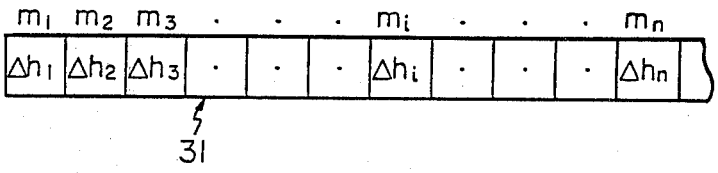
FIG. 2 is a schematic diagram of data writing condition of the memory device.

When the control according to the present invention is started, the thickness deviation $\Delta h$ and the speed of movement of the strip are outputted by the thickness meter 21 and the speed meter 22, respectively, and converted to digital signals by the A/D converters 30*a* and 30*b*, respectively, in synchronization with the pulse inputted from the timing circuit 32. From the above-mentioned speed of movement and the sampling period $\Delta t$, the distance of movement of the strip ST during the time period $\Delta t$ is stored in memory device 31. This distance is divided by a unit length to obtain $\Delta n_m$ which represents the number of memory areas in the memory device 31, into which the data obtained from the thickness meter 21 during the sampling should be written. The memory device 31 includes memory areas $m_1$, $m_2$ . . . $m_n$ . . . in the number equal to or greater than the value obtained by dividing the distance between the thickness meter 21 and the stand 15 by the unit length (assuming that the smaller the subscribed number is, to the more upstream portion is alloted the memory area and, on the contrary the greater the subscribed number is, to the more downstream portion is alloted the memory area for data writing, thus the memory area $m_1$ is alloted for the position of the thickness meter 21), the thickness deviation $\Delta h$ derived from the A/D converter 30*a* at the sampling time point at which $\Delta n_m$ was obtained is written into the memory areas $m_1 - m\Delta n_m$ as the value representative of the thickness deviation of the strip portion passing the thickness meter 21 between said sampling time point and the previous sampling time point. Similar processing is performed at the next sampling time point. Assuming that the number of the memory areas to be written into at said time point is $\Delta n_{m'}$, the data of the thickness deviation written into the memory areas $m_1 - m\Delta n_m$ at the previous sampling time point are shifted toward the memory area having the subscribed number greater than that by $\Delta n_{m'}$. That is, assuming that the datum of the thickness deviation read from the thickness meter at said sampling time point is $\Delta h'$, the content of the memory areas $m_1 - m\Delta n_m$, is $\Delta h'$ and the content of the memory areas $(m\Delta n_{m'}+1)-(m\Delta n_{m'}+\Delta n_m)$ is $\Delta h$. If this processing is repeatedly performed, the memory areas $m_1$, $m_2$ . . . $m_n$ . . . are written with the thickness devations of the strip portions corresponding thereto, respectively, in a predetermined length of time from the beginning of the control. Assuming that the distance between the thickness meter 21 and the stand 15 is $(n-1)$ times the unit length, the memory areas $m_1$, $m_2$ . . . $m_i$ . . . $m_n$ of the memory device 31 are in the state (see FIG. 2) in which the thickness deviation information $\Delta h_i$ of the strip portion spaced from the thickness meter 21 by the distance $(i-1)$ times $(i=1, 2 \ldots n)$ the unit length is always written. That is, the memory device 31 holds tracking information about the thickness deviation of the strip ST. The operation of writing into said memory and the computation of $\Delta n_m$ and others in the CPU are performed in synchronization with the pulse generated by the timing circuit 32. With the passage of time, the sum of the new data to be written and the data already written becomes greater than the number of the memory areas prepared in the memory device 31. In such an occasion, the older data is discarded before the newer, of course.

The arithmetic circuits 33 and 34 perform arithmetic operations in synchronization with the pulses generated by the timing circuit 32. Firstly, the circuit 33 performs the operation for correcting the delay in response of the screw down position control device and/or the tension adjusting device. The corrected value $\Delta C$ to be obtained is given by the following formula (1):

$$\Delta C = \Delta h_i + a_1 \frac{\Delta h_{i+u} - \Delta h_{i-u}}{2u \cdot \Delta t} + a_2 \frac{\Delta h_{i+v} - 2\Delta h_i + \Delta h_{i-v}}{(v \cdot \Delta t)^2} \quad (1)$$

in which $\Delta h_i$, $\Delta h_{i+u}$, $\Delta h_{i-u}$, $\Delta h_{i+v}$, and $\Delta h_{i-v}$ are data of the thickness deviation read out from the memory areas having i, i+u and i+v as the subscribed numbers determined by the subscribed numbers i, u and v selected adequately from the range 1—n; and $a_1$ and $a_2$ are constants.

These constants $a_1$ and $a_2$ are determined by the dynamic characteristics of the screw down position control device and/or the tension adjusting device. The detailed dynamic characteristics are measured beforehand and the constants $a_1$ and $a_2$ are predetermined with respect to the adequately selected i, u and v. While the formula (1) includes terms of $\Delta t$ up to the second order, it may include terms of $\Delta t$ up to the first order or up to the third or higher order. In the case where the terms up to the first order are included, the thickness deviations at three positions of the strip are the object of the data processing. In this case, $(\Delta h_{i+u}-\Delta h_{i-u})/2u\cdot\Delta t$ is an intermediate difference for calculating the difference of $\Delta h_i$, which may be substituted by a forward or backward difference. At this time, the formula for the difference is $(\Delta h_{i+u}-\Delta h_i)/u\cdot\Delta t$ or $(\Delta h_i-\Delta h_{i-u})/u\cdot\Delta t$, and the thickness deviations at two positions of the strip are the object of the data processing.

The position i on the memory is on the upstream side of the fifth stand. That is, viewing from the fifth stand, the thickness deviation in the future is used as $h_i$ in the formula (1). The position i on the upstream side is the position of the memory at which is stored the thickness deviation of the strip reaching the fifth stand $t_d$ second later moving at the present speed. An object of the feed forward control is to correct the dead time in response of the screw down position control device or the tension adjusting device. For this purpose, the thickness deviation at the position in future by the time period $t_d$ corresponding to the dead time is used in the control. Accordingly, the position i is the position on the memory determined by said time period $t_d$ and the speed of the strip. The positions u and v are determined likewise by the sampling time $\Delta t$ and the speed of the strip.

In the arithmetic circuit 34, a control signal $\Delta R$ to be applied to the control circuits 20 and/or 18 is calculated in the following formula (2) using the value $\Delta C$ obtained as described above:

$$\Delta R = K\cdot\Delta C \quad \ldots (2)$$

in which, character K is a constant determined by a reduction schedule such as the strip thickness and deformation resistance and the thickness control system (tension adjustment or screw down adjustment or both). The constant K is predetermined in correspondence to each of the conditions. The control signal $\Delta R$ is calculated at each input of the pulse from the timing circuit 32 and outputted at each calculation thereof to the control circuits 20 and/or 18 to take part in the control of the screw down position and/or the tension applied to the strip.

Figure 3:
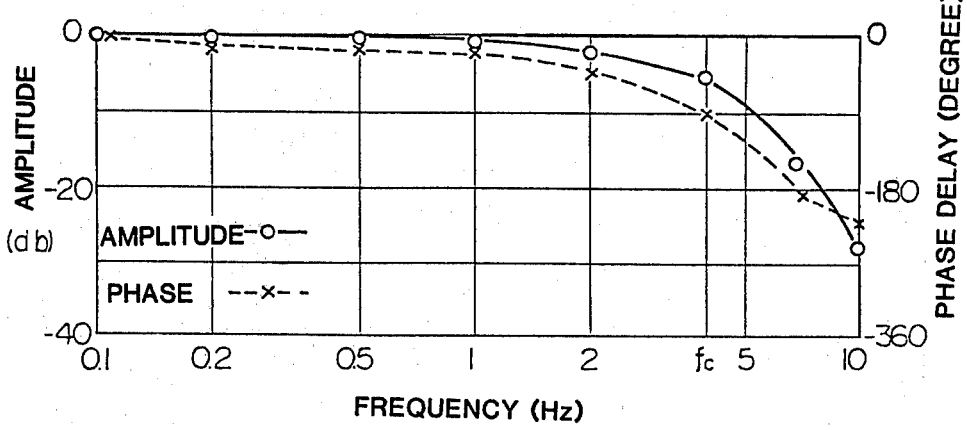
FIG. 3 is a frequency characteristic diagram for illustration of the cut-off frequency.

In the method according to the present invention, it is essential that the time $\Delta t$ which is the period of sampling, arithmetic operation and, accordingly, control is of the value equal to or smaller than 1/5 of the period of the cut-off frequency of the screw down position control device and/or the tension adjusting device. FIG. 3 shows a typical example each of the dynamic characteristics of the screw down position control and the tension adjustment relating to the results of measurement of the frequency characteristics of the amplitude and the phase delay. The value of the frequency at which the amplitude is ½—that is −3dB—of its maximum value is called a cut-off frequency $f_c$. The inventors have discovered that the correlation between the period $\Delta t$ and the cut-off frequency $f_c$ has the decisive influence on the effect of the strip thickness control and that a satisfactory effect of the strip thickness is obtained when the period $\Delta t$ is determined to a value equal to or smaller than 1/5 of the period $1/f_c$ of the cut-off frequency $f_c$. This is because, in calculation of the linear and the quadratic differentiations of the thickness deviation $\Delta h$ in the second and the third terms of the right side of the formula (1), it is very difficult to avoid errors in calculation and a large error occurs frequently. Accordingly, in order to prevent malfunction of the screw down position control system and the tension adjusting system, it is necessary to make the period $\Delta t$ equal to or smaller than 1/5 of the period $1/f_c$ of the cut-off frequency $f_c$.

In the method according to the present invention, as described above, because the thickness deviation of the strip on the entrance side of the rolling mill is sampled for every relatively short time period of $\Delta t \leqq 1/5f_c$ and tracked so as to correspond to each portion of the strip to the mill, and the screw down position and the tension are controlled with the same period $\Delta t$ on the basis of the thickness deviation being tracked, the problem of delay in response can be avoided, the variation of the strip thickness in high frequency can be followed up, and the accuracy in the strip thickness control can be sharply increased.

Figure 4A:
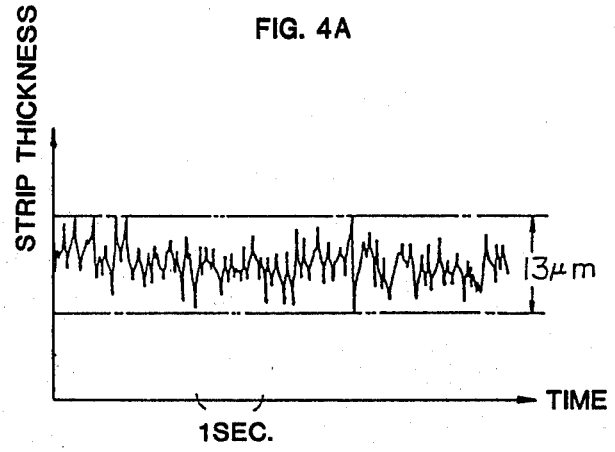
FIGS. 4(*a*) and 4(*b*) are diagrams showing the results of measurement of the strip thickness controlled in thickness by the method according to the present invention and by the conventional method, respectively.
Figure 4B:
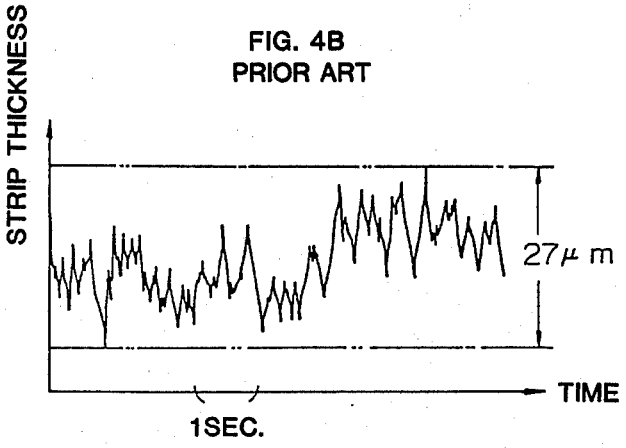
FIG. 4B PRIOR ART

The effect provided by the present invention will be clearly seen from FIGS. 4(*a*) and 4(*b*), in which FIG. 4(*a*) shows the results of measurement of the strip thickness on the exit side of the fifth stand 15 by the method according to the present invention and FIG. 4(*b*) shows the results of measurement of the strip thickness on the exit side of the final (fifth) stand of a tandem mill consisting of five stands by the conventional feed-forward system. As clearly seen from FIGS. 4(*a*) and 4(*b*), while the difference between the maximum and the minimum values of the strip thickness (target value 1.0 mm) was 27 μm in the conventional method, the difference was sharply reduced in the method according to the present invention to 13 μm which is smaller than a half of the difference in the conventional method. Thus, the effect of the method according to the present invention has been proved.

While the above example has been described with reference to the case in which the control of the strip thickness is performed at the fifth stand, the control of the strip thickness according to the present invention may be likewise performed, of course, at any of the other stands of the mill. Further, the method according to the present invention can be applied to a reversing mill comprising a single stand as well, in which case a rotation speed adjusting device functions also as the strip tension adjusting device and the rotation number detecting means of the deflector roll serves also as the speed meter.

As described above, the method according to the present invention has made it possible to perform a very fine control of the thickness of a strip being rolled by a strip mill and, accordingly, provides a significant effect of increasing the quality of the strip produced thereby.

We claim:

1. In a strip mill comprising a rolling mill for rolling a strip, a screw down position control device for adjusting the distance between the rolls of said rolling mill, a tension adjusting device for adjusting the tension applied to the strip, and a speed meter for detecting the speed of movement of the strip, a method for controlling thickness of the strip, comprising the steps of:

providing a thickness meter on the entrance side of the rolling mill for measuring deviations in the strip thickness from a predetermined thickness;

sampling an output of the thickness meter for each predetermined time period $\Delta t$ which is in a range which is equal to or smaller than 1/5 of the period of the cut-off frequency of at least one of the screw down position control device and the tension adjusting device;

storing, in a memory means having a plurality of storage locations, the deviations in the strip thickness measured by the thickness meter and existing at a plurality of positions located between the thickness meter and the rolling mill, the measured thickness deviations being stored in specific storage locations in the memory means on the basis of the speed of movement of the strip as measured by the speed meter;

computing a control signal for adjusting at least one of the screw down position control device and the tension adjusting device, using at least two of the stored thickness deviation values and the measured speed of the strip for each time period $\Delta t$; and outputting the computed control signal to at least one of the screw position control device and the tension adjusting device.

* * * * *